US007186137B2

(12) United States Patent
Rock

(10) Patent No.: US 7,186,137 B2
(45) Date of Patent: Mar. 6, 2007

(54) COILED CHARGING CABLE

(76) Inventor: Kenneth Rock, 1016 Rebecca Trail, Tallmadge, OH (US) 44278

( * ) Notice: Subject to any disclaimer, the term of this patent is extended or adjusted under 35 U.S.C. 154(b) by 0 days.

(21) Appl. No.: 11/299,145

(22) Filed: Dec. 7, 2005

(65) Prior Publication Data

US 2006/0134935 A1 Jun. 22, 2006

Related U.S. Application Data

(60) Provisional application No. 60/634,962, filed on Dec. 10, 2004.

(51) Int. Cl.
*H01R 11/00* (2006.01)
*H01R 11/32* (2006.01)

(52) U.S. Cl. ..... 439/502; 439/503; 439/35; 439/101

(58) Field of Classification Search ..... 439/502, 439/503, 101, 35, 675, 578; 320/25
See application file for complete search history.

(56) References Cited

U.S. PATENT DOCUMENTS 611,000 A * 9/1898 McElroy ..... 439/503
762,684 A * 6/1904 Case ..... 439/503
3,993,860 A * 11/1976 Snow et al. ..... 174/69
4,103,931 A 8/1978 Weiss
4,401,357 A 8/1983 Dvorachek et al.
4,675,473 A * 6/1987 Illakowicz ..... 174/68.1
4,846,697 A * 7/1989 Rodgers ..... 439/35
4,885,524 A * 12/1989 Wilburn ..... 320/105
6,036,533 A * 3/2000 Huang ..... 439/502
6,109,984 A 8/2000 Tsou
6,171,147 B1 1/2001 Nachbauer et al.
6,179,666 B1 * 1/2001 Osborn ..... 439/669
6,483,200 B1 11/2002 Jacobs
6,488,545 B1 * 12/2002 Meyer ..... 439/680
6,559,556 B1 * 5/2003 Wills ..... 307/10.1
6,780,021 B1 8/2004 Owen
7,008,273 B2 * 3/2006 Zhou ..... 439/874

* cited by examiner

*Primary Examiner*—Hien Vu
(74) *Attorney, Agent, or Firm*—Brouse McDowell; Roger D. Emerson; Timothy D. Bennett

(57) ABSTRACT

A cable for conducting electric current from a source receptacle to a load receptacle. The cable includes a primary cord including an electrical conductor with a first terminal end and a second terminal end, and a ground cord including an electrical conductor for establishing an electrical connection between a circuit including the cable and ground. A first plug is adapted to conduct the electric current between a contact provided to the source receptacle and the first terminal end, and a second plug is adapted to conduct the electric current between the second terminal end and a contact provided to the load receptacle. At least one of the first plug and the second plug is compatible with a single-prong receptacle.

10 Claims, 5 Drawing Sheets

COILED CHARGING CABLE

This application claims priority to provisional patent application Ser. No. 60/634,962, entitled COILED CHARGING CABLE, filed Dec. 10, 2004, which is incorporated herein by reference.

I. BACKGROUND OF THE INVENTION

A. Field of Invention

The present invention is directed generally to an electrical conductor for conducting electrical energy to a load, and more particularly to a cable with a feature for establishing electrical communication with ground.

B. Description of the Related Art

Traditionally, the electrical connection between tractors and trailers that navigate public roads are grounded through the trailer kingpin and fifth-wheel hitch assembly. These trailer features are exposed to weather that can cause corrosion of the hitch assembly, as well as grease, dirt and debris that can each form a significant impedance the flow of electric current through a circuit. Such an impedance leads to low voltage or faulty ground-wire connections that frequently cause failure in trailer accessories such as battery chargers, mechanized liftgates and lights. A failure of this nature can require roadside assistance and extended periods of downtime for the trailer, each of which are costly for fleet managers and owner/operators.

To avoid the problems associated with grounding through a fifth-wheel hitch assembly, others have attempted to establish an electrical connection to ground with a seven-way plug. The seven-way plug includes seven conductors that cooperate with a compatible receptacle on the trailer and/or the tractor to establish an electrical connection therebetween. One of the seven conductors is dedicated as a ground conductor that is coupled to a grounded cable. The grounded cable typically has a larger cross-sectional diameter than the cable coupled to each of the other 6 conductors in the plug. Despite the enlarged grounded cable, however, the electrical connection to ground is inadequate for the electrical power requirements of common features on trailers such as liftgates.

Attempts have been made to implement large-diameter grounding cables to satisfy the grounding requirements of power-intensive features found on trailers. Large-diameter cables, however, are typically rigid, and make the electrical conductor between a tractor and a trailer bulky and rigid when combined with the six other cables coupled to the remaining conductors of the seven-way plug. As the position of the trailer relative to the tractor changes, such as when the tractor and trailer turn a corner, the rigid electrical conductor can cause the plug to be forced from the tractor or the trailer, thereby disrupting the electrical connection.

Accordingly, there is a need in the art for a cable to establish a suitably-grounded electrical connection between a source receptacle provided to a tractor and a load receptacle provided to a trailer. The cable can also optionally compensate for changes in the position of the trailer relative to the tractor.

II. SUMMARY OF THE INVENTION

According to one aspect, the present invention provides a cable for conducting electric current from a source receptacle to a load receptacle. The cable includes a primary cord including an electrical conductor with a first terminal end and a second terminal end, and a ground cord including an electrical conductor for establishing an electrical connection between a circuit including the cable and ground. A first plug is adapted to conduct the electric current between a contact provided to the source receptacle and the first terminal end, and a second plug is adapted to conduct the electric current between the second terminal end and a contact provided to the load receptacle. At least one of the first plug and the second plug is compatible with a single-prong receptacle.

According to another aspect, the present invention provides A trailer to be towed by a tractor. The trailer includes a floor for supporting contents to be transported by the trailer, a mechanized platform assembly for transferring the contents to be transported by the trailer between a first elevation and an elevation substantially level with an elevation of the floor, and a battery to supply electric energy for operation of the mechanized platform. A trailer receptacle having a single-prong is provided to the trailer for receiving electric current conducted to the trailer to charge the battery, and a cable conducts electric current between a source receptacle to the trailer receptacle, wherein the cable includes a primary cord with an electrical conductor with a first terminal end and a second terminal end, and a ground cord including an electrical conductor for establishing an electrical connection between a circuit including the cable and ground. A first plug is adapted to conduct the electric current between a contact provided to the source receptacle and the first terminal end, while a second plug compatible with the single-prong trailer receptacle to conduct the electric current between the second terminal end and the single-prong of the trailer receptacle.

Still other benefits and advantages of the invention will become apparent to those skilled in the art to which it pertains upon a reading and understanding of the following detailed specification.

III. BRIEF DESCRIPTION OF THE DRAWINGS

The invention may take physical form in certain parts and arrangement of parts, a preferred embodiment of which will be described in detail in this specification and illustrated in the accompanying drawings which form a part hereof and wherein.

IV. DESCRIPTION OF THE PREFERRED EMBODIMENT

Figure 1:
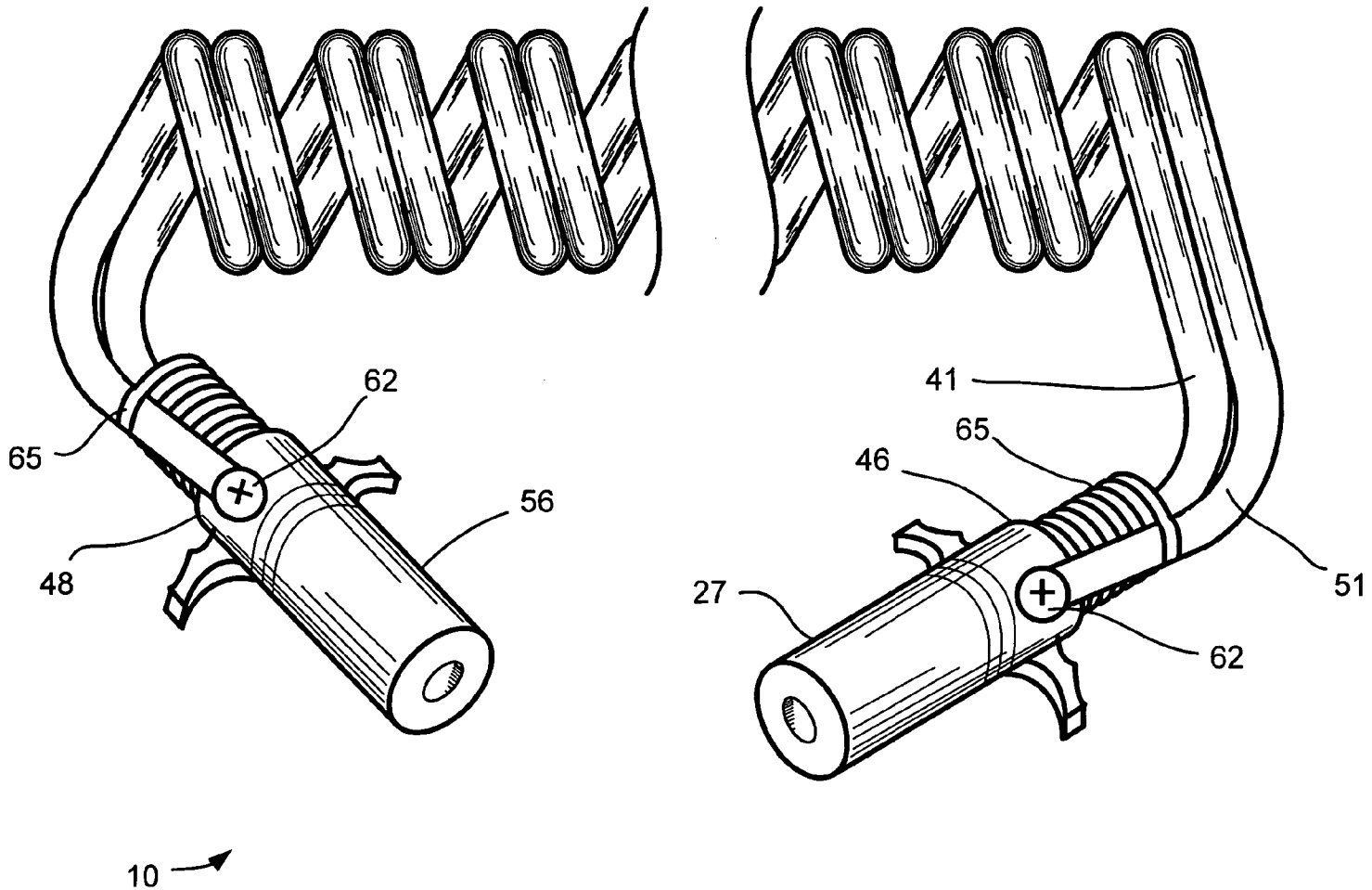
FIG. 1 is a perspective view of a cable in accordance with an aspect of the present invention.

Certain terminology is used herein for convenience only and is not to be taken as a limitation on the present invention. Relative language used herein is best understood with reference to the drawings. Further, in the drawings, certain features may be shown in somewhat schematic form.

The present technology is generally directed toward a cable 10, illustrated schematically in FIG. 1, for conducting electric current from a source receptacle outlet to a load receptacle outlet 12 provided to a trailer or other object that requires electric current from an external source for operation. The cable 10 comprises a primary cord 41 including an electrical conductor 44 (FIG. 3) that extends from a first terminal end 46 to a second terminal end 48. A ground cord 51 including an electrical conductor is also provided to the cable 10 for establishing an electrical connection between a circuit including the cable 10 and ground.

Figure 5:
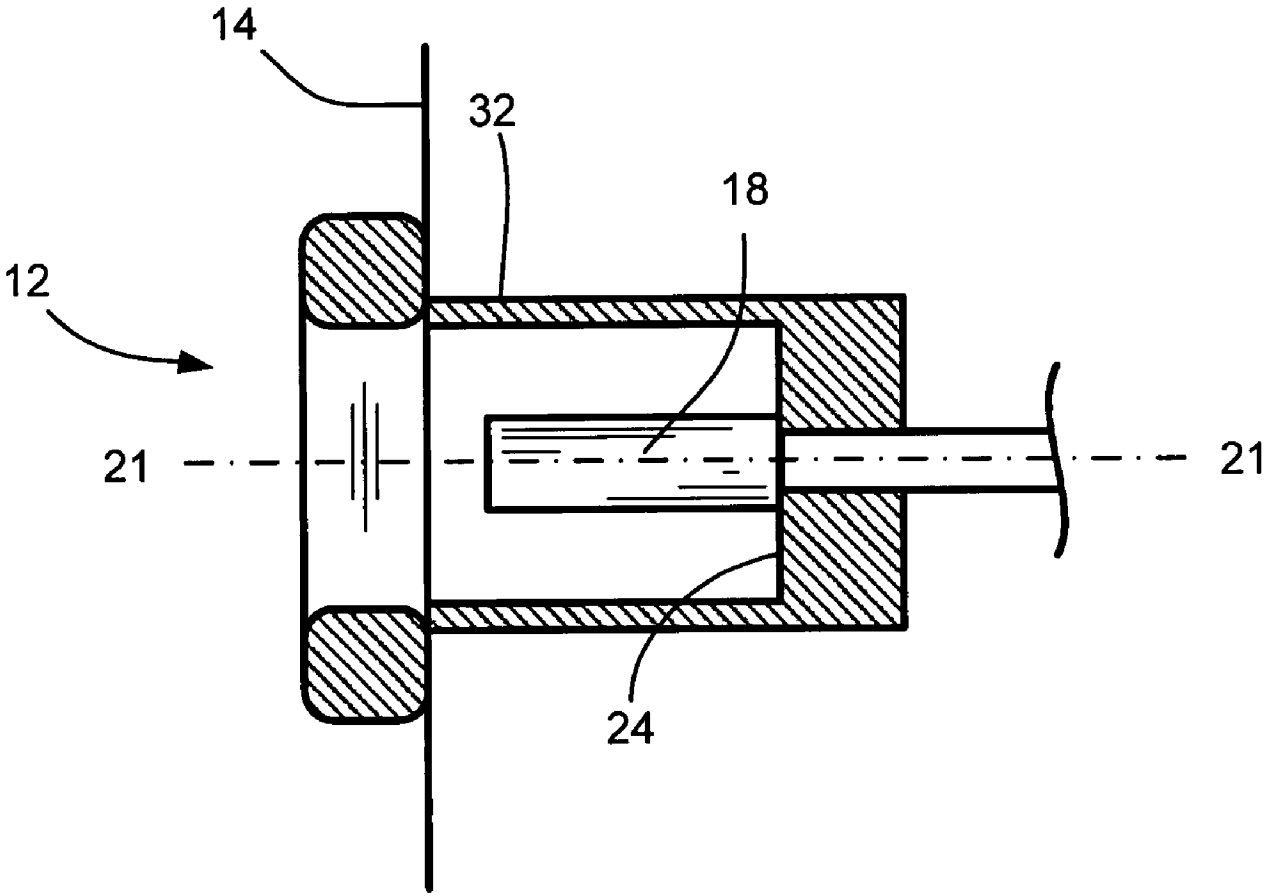
FIG. 5 is a cross-sectional view of a load receptacle.
Figure 6:
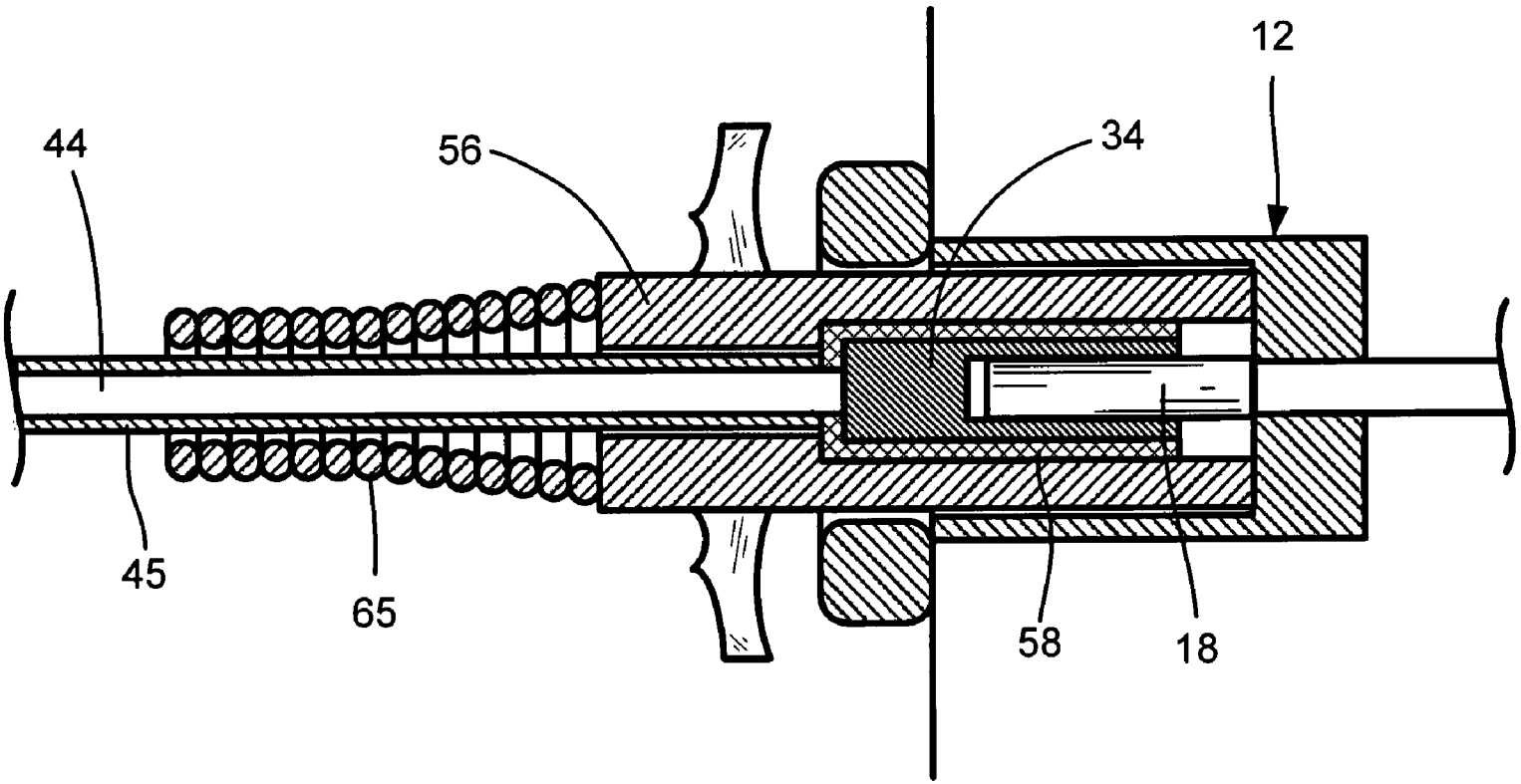
FIG. 6 is a cross-sectional view of a plug installed in a load receptacle of a trailer to establish an electrical connection therebetween.

A first plug 27 is coupled adjacent to the first terminal end 46 of the primary cord 41 is adapted to conduct electric current between a contact 18 provided to the source receptacle and the first terminal end 46 of the primary cord 41. Likewise, a second plug 56 is coupled adjacent to the second terminal end 48 of the primary cord 41 to conduct electric current between the second terminal end 48 and a contact 18 provided to the load receptacle 12 (FIGS. 5 and 6). At least one of the first plug 27 and the second plug 56 is compatible with a single-prong receptacle, as described in detail below.

Figure 4:
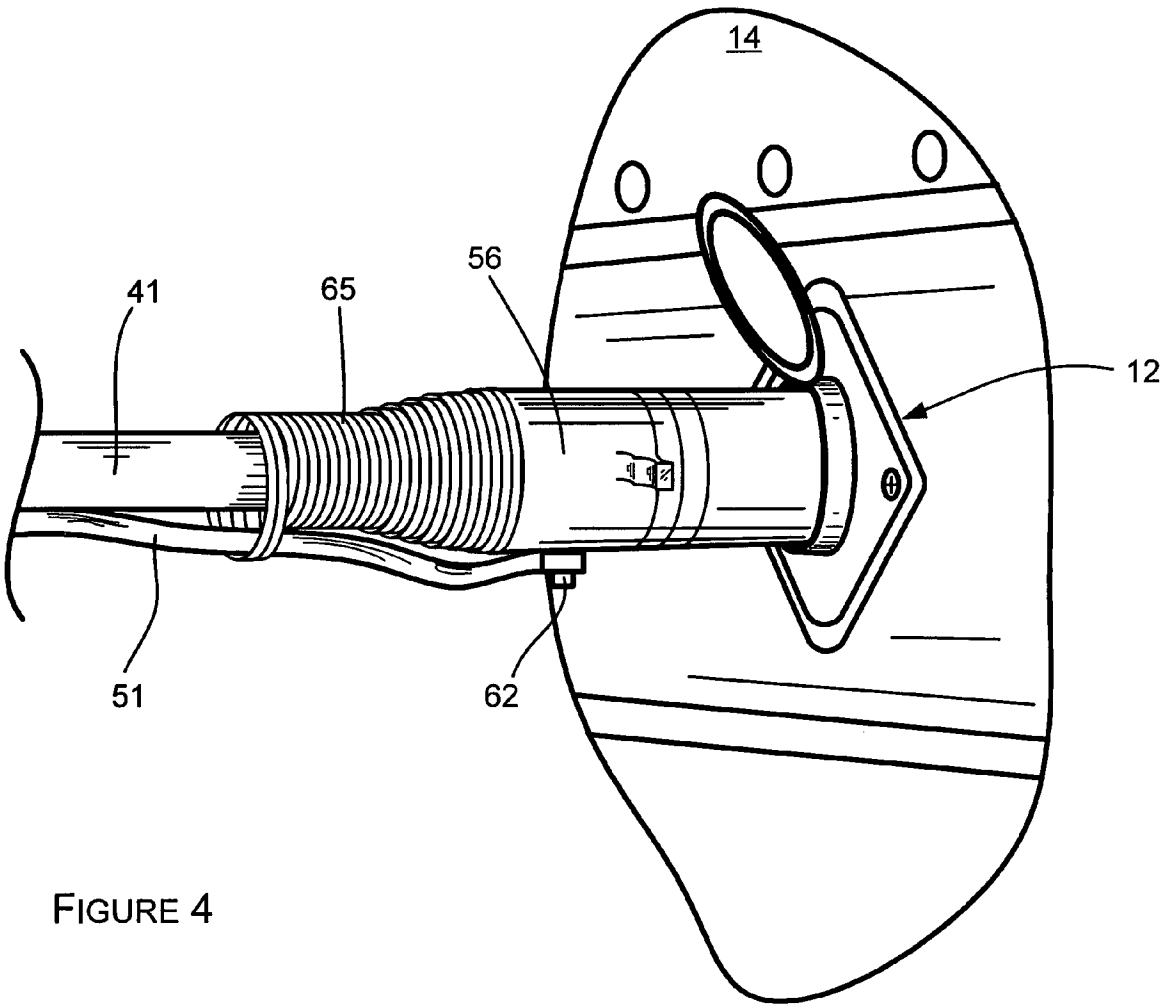
FIG. 4 is a prospective view of a plug provided to an end of a cable in accordance with an embodiment of the present invention, the plug being inserted into a load receptacle provided to a trailer.

An example of the arrangement of receptacles mentioned above is that commonly found on tractor/trailer combinations that navigate public roads. The trailer typically includes at least one of a battery, a light, a mechanized feature such as a liftgate, a refrigeration unit, or any other electrical component. While the engine of the tractor is running, a generator commonly referred to as an alternator harnesses the rotational motion of engine components to generate electrical energy that can be used to charge the engine battery, as well as to charge the trailer battery and operate one or more of the features of the trailer. FIG. 4 illustrates a load receptacle 12, also referred to herein as a trailer receptacle 12, exposed to the exterior of a trailer 14 to act as an input to the electrical system of the trailer 14. Electric energy generated by the alternator or any other electric-generation feature of the tractor/trailer combination can be input to the trailer's electrical system via the load receptacle 12.

A cutaway view of the load receptacle 12 is shown in FIG. 5. The load receptacle 12 includes a single-prong, male electrical contact 18 that protrudes outwardly along a longitudinal axis 21 from a backing portion 24 of the receptacle 12 and can be received by the compatible, single-prong female plug 56 as shown in FIG. 6. Although the single-prong male contact 18 protrudes from a backing portion 24 of the receptacle 12, the backing portion 24 of the load receptacle 12 can be sufficiently recessed such that the single-prong male contact 18 is disposed within a protective housing 32 of the load receptacle 12. As a load receptacle, the male contact 18 will be described as receiving electric current from the cable 10, but the cable 10 of the present invention can support the flow of electric current in either direction.

Figure 2:
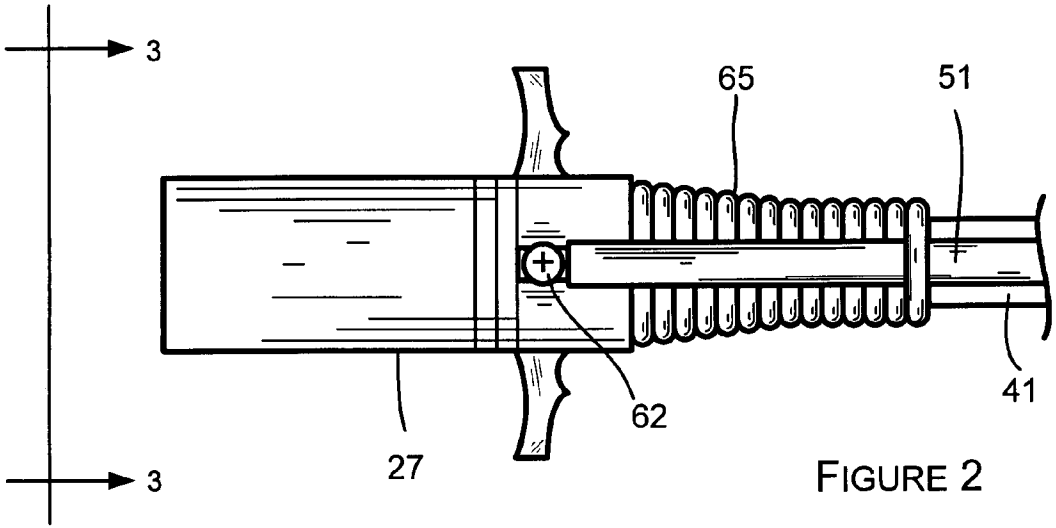
FIG. 2 is a top view of a plug provided adjacent to a terminal end of a cable.
Figure 3:
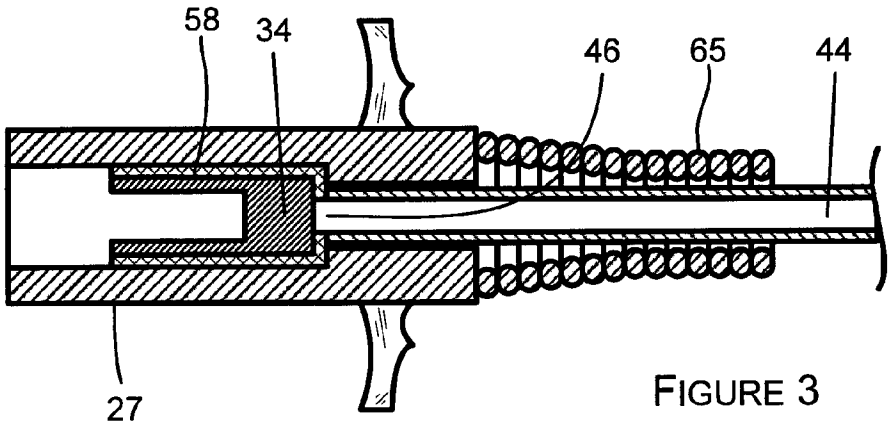
FIG. 3 is a cutaway view of the plug shown in FIG. 2.

According to this arrangement, at least a portion of the female plug 56 shown in FIG. 2 can be inserted into the protective housing 32 where a female receptor 34 of the plug can receive the male contact 18 and establish an electrical connection between the two features. FIG. 3 is a cross-sectional view taken along line 3—3 in FIG. 2, and shows an example of a female receptor 34 that has a generally U-shaped cross section for receiving a compatibly-shaped male contact 18 of the load receptacle 12. When the plug 56 is inserted into the load receptacle 12, the female receptor 34 within the plug 56 physically touches the male contact 18 to establish the electrical connection as shown in FIG. 6. The contact between the male contact 18 and the female receptor 34 allows electric current to be conducted from the electric conductor 44 of the primary cord 41, through the female receptor 34 and to the male contact 18, from where it is conducted to the electrical system of the trailer 14. As conductors of electric current, each of the male contact 18 and the female receptor 34 can be fabricated from any conductor of electricity such as copper, aluminum, gold, silver, any other metal, an alloy thereof, or any other material that can conduct electric current.

Similarly, a source receptacle (not shown) can be exposed to the tractor's exterior to act as an output from the tractor's electrical system. Electric energy generated by the alternator or other generation feature can be withdrawn by a load through the source receptacle. Although not shown in the FIGURES, the source receptacle is optionally analogous to the load receptacle 12 provided to the trailer 14. It can include a single-prong male contact that protrudes outwardly from a backing portion of the source receptacle, but is disposed within a protective housing. Also similar to the electrical connection between the load receptacle 12 and the trailer 14, a female plug 56 such as that provided adjacent to the second terminal end 48 of the primary cord 41 can be inserted into the protective housing of the source receptacle. From there, a female receptor within the plug 56 can receive the male contact and establish an electrical connection between the two features.

Although the source and load receptacles are described herein as including a male contact 18 and the plugs 27, 56 as including a female receptor 34, each of the receptacles 12 and plugs 27, 56 described can independently be selected as male or female without departing from the scope of the present invention. However, in order for a plug 27, 56 and a receptacle 12 to be compatible so as to establish an electrical connection therebetween, the plug 27, 56 and the receptacle 12 must be of the opposite sex. Accordingly, a female plug 27 can cooperate with a male receptacle 12 to establish an electrical connection between the female receptor 34 and the male contact 18. Likewise, a male plug (not shown) could cooperate with a female load receptacle outlet (not shown) to also establish an electrical connection that could conduct electric current from the primary cord 41 to the trailer's electrical system.

The electric conductor 44 of the primary cord 41 can be fabricated from any conductor of electricity such as copper, aluminum, gold, silver, any other metal, an alloy thereof, or any other material that can conduct electric current. Further, the electric conductor 44 can comprise a single conducting strand, or a plurality of conducting strands that are twisted, braided, or otherwise bound together to form a conducting cord. A sleeve 45 of a dielectric material conceals the electric conductor 44 of the primary cord 41 between the first and second plugs 27, 56, and can optionally electrically insulate the electric conductor 44 from one or both plugs 27, 56.

As shown in FIGS. 3 and 6, there is a dielectric insulator 58 inside each female plug 27, 56 that allows the electric conductor 44 to be coupled to the female receptor 34 in a manner that allows electric current to flow from the electric conductor 44 to the female receptor 34. The insulator 58, however, electrically insulates the female receptor 34 to prevent current from flowing from the female receptor 34 to the surrounding portions of the plug 27. In fact, a dielectric insulator is suitably provided to prevent electric current being conducted by the electric conductor 44 from being conducted to the plugs 27, 56.

A ground cord 51 with an electrical conductor sheathed in a dielectric material is provided to establish an electrical connection between the trailer or other load and ground. The ground cord 51 can be coupled to the primary cord 41 such that their positions are fixed relative to each other, or the ground cord 51 can be coupled to the primary cord 41 at desired locations along the length of the cable 10. As shown in FIG. 1, the sheath of dielectric material of the ground cord 51 is chemically bonded to the dielectric sheath of the primary cord 41, thereby fixing the relative of each cord 41, 51 relative to the other along the length of the cable 10. A support 65 can optionally be provided to support the connection of at least one of the primary cord 41 and the ground cord 51 to one or both of the plugs 27, 56. The support 65 can optionally encircle the ground cord 51 adjacent to one or both plugs 24, 56 to maintain the relative position of the ground cord 51 to the primary cord 41.

The coupled primary and ground cords 41, 51 are also coiled in FIG. 1 to minimize the length of the cable 10 in a relaxed, unbiased state. When the plugs 27, 56 are forced in opposite directions, the coiled primary and ground cord 41, 51 combination will expand similar to a coil spring being stretched to span the distance needed between the repositioned plugs 27, 56. When the plugs 27, 56 are returned to their unbiased, relaxed positions, the primary and ground cord 41, 51 combination returns to its tightly coiled condition.

Although the primary cord 41 and the ground cord 51 can be coupled together, the electrical conductor of each of the primary cord 41 and the ground cord 51 are electrically insulated from each other. An electrical connection can be established between the electrical conductor of the ground cord 51 and each plug 27, 56 by coupling a terminal end of the ground cord's electrical conductor to each plug 27, 56. In the FIGURES, each plug is formed from an electrically-conducting material such as a metal. But similar to the electrical conductor of the primary cord 41, the plug can be fabricated from any conductor of electricity such as copper, aluminum, gold, silver, any other metal, an alloy thereof, or any other material that can conduct electric current.

According to other embodiments, both the primary cord 41 and the ground cord 51 can be enclosed within the same dielectric sheath, electrically insulated from each other by a dielectric lining.

An electrical connection between the ground cord's electrical conductor and each plug 27, 56 is established by contacting the electrical conductor at each end to one of the plugs 27, 56. The contact between the ground cord's electrical conductor and each plug 27, 56 can independently be maintained using a mechanical fastener such as a screw or a bolt, a clamping mechanism, or by other types of fasteners such as molding the terminal end of the ground cord's electrical conductor directly to the plug. Any method can be employed to couple each terminal end of the ground cord's electrical conductor to a plug 27, 56 to maintain the electrical connection therebetween without departing from the scope of the present invention. As shown in FIGS. 1 and 2, a phillips-head screw is inserted into a threaded channel in each plug 27, 56 with the ground cord's conductor compressed between the head 62 of the screw and the respective plug 27, 56.

The size of both the electrical conductor of the primary cord 41 and the electrical conductor of the ground cord 51 can be independently selected in the exercise of sound engineering judgment to satisfy the electrical demands of the particular application for which the cable 10 is to be used. However, embodiments of the present invention include a primary cord 41 with an electrical conductor that is a stranded conductor having a cross-sectional diameter of at least zero (0) AWG, or larger, and a ground cord 51 with an electrical conductor having a cross-sectional diameter of at least two (2) AWG or larger, wherein AWG represents the American Wire Gauge standard. Other embodiments include single-strand electrical conductors of the same sizes, and still other embodiments include a primary cord 41 comprising an electrical conductor capable of conducting 190 amps at 12 volts.

FIG. 4 illustrates use of the cable 10 to input electric energy into the trailer's electrical system. The trailer 14 can optionally be equipped with a liftgate or any other electrically-operated device that requires electric current from a battery or other source. Electric current can be delivered through the load receptacle 12 to charge the battery, directly operate the liftgate, or for any other purpose. A liftgate (not shown) is a mechanized platform that is affixed to the trailer 14 to raise and lower articles being placed into and removed from the trailer 14. Although referred to as a gate, which typically is located adjacent to the rear of the trailer, the liftgate can actually be placed at any location on the trailer 14 adjacent to a location that is suitable for loading and unloading the trailer 14. The liftgate can be operated by hydraulic actuators, a system of gears, pulleys, any combination thereof, or any other actuation mechanism, and can draw electric current required for operation from a battery.

When the liftgate is operated while the tractor's engine is not running, the battery supplies the electric current needed for operation of the liftgate. When the tractor's engine is running, however, the electric energy generated by the alternator can be used to charge the battery, and optionally contribute electric current to drive the liftgate. The cable 10 of the present invention can conduct the electric energy from the source receptacle of the tractor to the load receptacle 12 of the trailer 14, from where it can be delivered by the trailer's electrical system to charge the battery, operate lights on the trailer, a liftgate, a refrigeration unit, any combination thereof, or to serve any other suitable purpose.

To install the cable 10, the second plug 56 is at least partially inserted into the protective housing 32 of the load receptacle 12 to establish contact between the female receptor 34 of the plug 56 and the male contact 18 of the load receptacle 12, as shown in FIG. 6. Electric current can be conducted through the electrical conductor of the primary cord 41, through the female receptacle 34, and then through the male contact 18 on its way to the electrical system of the trailer 14.

While installed in the load receptacle 12 as described above, at least a portion of the plug 56 makes physical contact with an electrically-conducting portion of the load receptacle 12 to establish an electrical connection between the plug 56 and the load receptacle 12. As with the other electrically-conducting features described herein, the electrically-conducting portion of the load receptacle 12 that makes contact with the plug 56 is also fabricated from any conductor of electricity such as copper, aluminum, gold, silver, any other metal, an alloy thereof, or any other material that can conduct electric current. Since the load receptacle is itself mounted to the chassis of the trailer 14, an electrical connection between the load receptacle 12 and the trailer's chassis can be established. Currents that could otherwise build within the chassis of the trailer 14 faster than can be dissipated can instead be conducted to ground by the ground cord 51. This enhanced ground connection through the ground cord 51 ensures that the proper voltage reaches the electrical components of the trailer 14.

From the above description of the invention, those skilled in the art will perceive improvements, changes and modifications. Such improvements, changes and modifications within the skill of the art are intended to be covered by the appended claims.

The preferred embodiments have been described, hereinabove. It will be apparent to those skilled in the art that the above methods may incorporate changes and modifications without departing from the general scope of this invention. It is intended to include all such modifications and alterations in so far as they come within the scope of the appended claims or the equivalents thereof.

I claim:

1. A cable for conducting electric current from a source receptacle to a load receptacle, the cable comprising:

a primary cord including an electrical conductor with a first terminal end and a second terminal end;

a ground cord including an electrical conductor with a first terminal end and a second terminal end, wherein the electrical conductor of the ground cord is separated from the electrical conductor of the primary cord by a dielectric material;

a first plug adapted to conduct the electric current between a contact provided to the source receptacle and the first terminal end of the primary cord's electrical conductor;

a second plug formed at least in part from an electrically-conductive material that contacts an electrically-conductive portion of a housing of the load receptacle when installed therein to establish an electric connection between the ground cord and the load receptacle, the second plug also being adapted to facilitate the conduction of electric current between the second terminal end of the primary cord and a contact provided to the load receptacle, wherein at least one of the first plug and the second plug is compatible with a single-prong receptacle;

a first fastener electrically connecting the first terminal end of the ground cord's electrical conductor to the first plug; and a second fastener electrically connecting the second terminal end of the ground cord's electrical conductor to the second plug for establishing electrical communication between the ground cord and the second plug.

2. The cable according to claim 1, wherein the electrical conductor of the primary cord comprises a plurality of conducting strands that are coupled together.

3. The cable according to claim 1, wherein the primary electrical conductor comprises a single conducting member.

4. The cable according to claim 1, wherein the primary cord is helically coiled.

5. The cable according to claim 1, wherein the electrical conductor of each of the primary cord and the ground cord includes a metallic conductor that is radially enclosed by a sheath of dielectric material.

6. The cable according to claim 5, wherein the primary cord is coupled to the ground cord.

7. The cable according to claim 1, wherein the electrical conductor of the primary cord is zero wire gauge or larger according to the American Wire Gauge standard.

8. The cable according to claim 7, wherein the electrical conductor of the ground cord is 2 wire gauge or larger according to the American Wire Gauge standard.

9. The cable according to claim 1, wherein the primary cord is rated to conduct an electric current of at least 190 amps at a voltage 12 volts.

10. The cable according to claim 1, wherein at least one of the first and second plugs is a female plug.

* * * * *